United States Patent [19]

Lautenschläger, Jr.

[11] Patent Number: 5,062,180

[45] Date of Patent: Nov. 5, 1991

[54] MOUNTING PLATE FOR CABINET HINGES

[75] Inventor: Karl Lautenschläger, Jr., Reinheim, Fed. Rep. of Germany

[73] Assignee: Karl Lautenschläger GmbH & Co. KG, Reinheim, Fed. Rep. of Germany

[21] Appl. No.: 541,255

[22] Filed: Jun. 20, 1990

[30] Foreign Application Priority Data

Jun. 20, 1989 [DE] Fed. Rep. of Germany ... 8907480[U]

[51] Int. Cl.[5] ..... E05D 7/04; E05D 7/12

[52] U.S. Cl. ..... 16/257; 16/336; 16/DIG. 43

[58] Field of Search ..... 16/DIG. 43, 249, 251, 16/257, 258, 272, 324, 336

[56] References Cited

U.S. PATENT DOCUMENTS 4,841,598 6/1989 Grass ..... 16/257

*Primary Examiner*—Robert L. Spruill
*Assistant Examiner*—Carmine Cuda

[57] ABSTRACT

Mounting plate for the adjustable mounting of the supporting wall-related part of a cabinet hinge composed of two separable mounting plate members of which the bottom mounting plate member nearer the supporting wall can be fastened fixedly to the supporting wall and the upper mounting plate member more remote from the supporting wall and adjustably mounting the carcase-related part of the cabinet hinge can be joined by a spring catch mechanism to the bottom mounting plate member. The bottom mounting plate member has in its front end area facing the door leaf at least one projecting hook with which a hook receiver on the bottom of the upper mounting plate member is associated. The upper mounting plate member partially overlaps the bottom mounting plate member at least in its end area pointing into the carcase interior, and in the overlapping area is provided with two tongues resiliently flexible parallel to the supporting wall surface; the tongues have each a catch section and the catch sections are form-lockingly caught each by an associated catch receiver in the bottom mounting plate member, the catch sections and the catch receivers being at an angle between 30° to 60° with respect to the longitudinal central axis of the mounting plate. By bending the tongues toward one another parallel to the supporting wall surface the catch sections and catch receivers can be brought out of engagement, the upper mounting plate member then being able to be swung upward by using sections of the tongues as finger grips.

18 Claims, 7 Drawing Sheets

MOUNTING PLATE FOR CABINET HINGES

BACKGROUND OF THE INVENTION

The invention relates to a mounting plate for the adjustable mounting of the supporting wall-related part of a cabinet hinge, which is composed of two separable mounting plate members, of which the bottom mounting plate member nearer the supporting wall can be fastened fixedly to the supporting wall and the upper mounting plate member, which is farther from the supporting wall and adjustably holds the carcase-related member of the cabinet hinge, can be fastened by a resilient catch mechanism to the bottom mounting plate member, the bottom mounting plate member having in its front end portion adjacent the door leaf at least one hook projection with which a hook on the bottom of the upper mounting plate member is associated, and the associated engagement surfaces of the hook projection and hook being configured in a complementary manner and being approximately arcuate at least in sections, and the upper mounting plate member partially overlapping the bottom mounting plate member at least in its end portion pointing into the carcase interior and being provided in the overlapping portion with two tongues which are resiliently flexible parallel to the supporting wall surface and have each a catch section; these catch sections are interlocked each with an associated catch receiver, and the catch sections and the catch receivers being able nevertheless to be brought out of engagement by flexing the tongues against one another parallel to the supporting wall surface, and each tongue having a finger grip that is accessible when the two mounting plate members are in the coupled state for the exertion of a pressure directed against one another parallel to the supporting wall surface.

Bipartite mounting plates for double-jointed hinges are known, in which the upper mounting plate member is releasably joined to the bottom mounting plate member by a catch mechanism provided at the carcase-interior end of these mounting plate members. In these mounting plate members it is possible to remove successively from the supporting wall the hinges attached at the other end to the door leaf, or to attach them thereto, without the need for difficult manipulations, by operating the catch mechanism and then swinging away the hinge supporting arm together with the upper mounting plate member that is joined to it. This is an advantage especially in the case of tall cabinets in which the door leaves are hung on the carcase with more than two hinges, because the door leaves can then be removed—and rehung—even by one person. The catch mechanism of a known hinge (DE-OS 35 25 279) is formed by a slide guided in the bottom mounting plate member and biased by a separate spring to the catching position; the slide has a catch projection with a sloping catch surface which is held resiliently in engagement with a complementary sloping catch surface in the upper mounting plate member. The slide is operated by means of a finger grip which is disposed on the rear prolongation of the slide pointing into the carcase interior. This catch mechanism has proven quite practical, but it is relatively complex in construction and accordingly expensive. The finger grip provided on the carcase-interior end of the mounting plate is operated by exerting an unlocking movement on the finger grip, outwardly from the carcase interior. Now, it is not entirely impossible that, in the case of a very fully packed cabinet, the finger grip might accidently be pushed in the unfastening direction when the door leaf is closed—for example, if the finger grip comes in contact with a projecting clothes hanger or some other projecting object, before the door leaf is fully closed. In the most unfavorable case this might then cause the hinge to come unfastened and the door to fall, if the door is hung on the carcase with only two hinges. By configuring the mounting plate in the manner mentioned in the beginning with a double catch mechanism which can be disengaged by squeezing the finger grips together, the above-described disadvantages of the prior state of the art have largely been overcome, i.e., unintentional release is virtually no longer possible, while intentional release and the swinging away of the supporting wall-related part together with the upper mounting plate member is very simple.

It is the object of the invention to improve the mounting plate according to the principal patent such that an additional improvement of operation will be achieved without complication of the catch mechanism.

THE INVENTION

Setting out from a mounting plate of the kind mentioned in the beginning, this object is achieved in accordance with the invention in that the catch sections provided on the resiliently flexible tongues and the associated catch receivers are at an angle between 30° to 60°, preferably approximately 45°, with respect to the longitudinal central axis of the mounting plate.

In an advantageous further improvement of the invention, the upper mounting plate member has an inverted U-shaped cross section with an elongated upper web having flanges on its longitudinal edges at least partially overlapping the sides of the bottom mounting plate member, the two resilient tongues being fastened at their front end pointing out of the carcase interior to the upper mounting plate member, and being shaped in their resilient portion toward the carcase interior in such a manner that they project laterally at least in sections beyond the limits of the upper mounting plate member to form the finger grips, and furthermore between the confronting inner surfaces of the resilient tongue and the surfaces of the mounting plate members facing them a free space exists which permits the horizontal deformation of the tongues against one another by the amount required for release. The slope of the catch sections of the tongues and of the corresponding catch receivers in conjunction with the arcuate release or catching movement result in a shortened actuating movement without impairing the security of the catch.

To achieve the simplest possible configuration of the catch mechanism it is recommendable to form the resilient tongues as integral strip-like sections cut free of the material of the upper mounting plate member, although it is fundamentally possible also, of course, to make these tongues separately and then fasten them to the upper mounting plate member.

In accordance with the configuration of the mounting plate in the principal patent, the catch receivers provided in the bottom mounting plate member can best have on the top side facing the upper mounting plate member an opening for the entry of the catch sections provided on the resilient tongues, the entry opening and/or the catch sections being provided each with at least one ramp surface which upon insertion resiliently forces the associated catch section in the release direction and, adjoining the ramp surface in the direction of insertion, being provided each with an undercut behind which the catch sections snap back upon when the two mounting plate members reach the proper engaging position.

At the same time the resilient tongues even in the present further improvement can be divided adjacent to their fastening area on the upper mounting plate member or at the areas of their transition into the associated lateral flange of the upper mounting plate member, into a plurality of tongue sections running at an angle to one another, the first of which is bent outwardly, the adjoining tongue section is bent back to a position running approximately parallel to the mounting plate's longitudinal central axis, and the next adjoining tongue section is bent approximately at right angles to the longitudinal central axis, while the terminal sections adjoining the tongue sections bent at right angles to the longitudinal central axis and forming the actual catch sections, are bent to a position at an angle to the longitudinal central axis.

To make the locking engagement of the tongues' catch sections in the catch receivers of the bottom mounting plate member as stiff as possible in the detaching direction, i.e., at right angles to the supporting wall surface, the configuration can be made such that the tongue sections bent at approximate right angles to the longitudinal central axis are guided by a notch in the carcase-interior end portion of the associated lateral flange of the upper mounting plate member, and the inside width of the notches measured at right angles to the supporting wall surface is approximately equal to or only slightly larger than the width of the tongue in the area passing through the notch. The guidance of the tongue in this notch prevents the tongue from shifting relative to the upper mounting plate member at right angles to the supporting wall surface, while on the other hand the tongues are able to perform the flexure parallel to the supporting wall surface that is required for release.

In a first embodiment, the tongue sections forming the catch section can be bent from the tongue sections bent at right angles to the longitudinal central axis to a slanting position having a component pointing out of the carcase.

Alternatively, the tongue sections forming the catch section can also be bent from the tongue sections bent approximately at right angles to the longitudinal central axis to a slanting position having a component pointing into the carcase interior.

In the last-named case, a tongue section running substantially parallel to the longitudinal central axis of the mounting plate can be added to the tongue sections forming the catch section and can be brought through a window-like slot in a wall bent from the carcase-interior end of the web of the upper mounting plate member in the direction of its lateral flanges, in which case the clear height of this window-like opening, measured at right angles to the supporting wall surface, is approximately equal to or only slightly greater than the height of the tongue section passing through it, while the clear width of the opening measured in the direction of actuation of the tongue when releasing is sized in accordance with the distance the tongue has to be flexed for release.

BRIEF DESCRIPTION OF THE DRAWINGS

The invention will be further explained in the following description of three embodiments, in connection with the drawing, wherein.

DETAILED DESCRIPTION OF PREFERRED EMBODIMENTS

Figure 1:
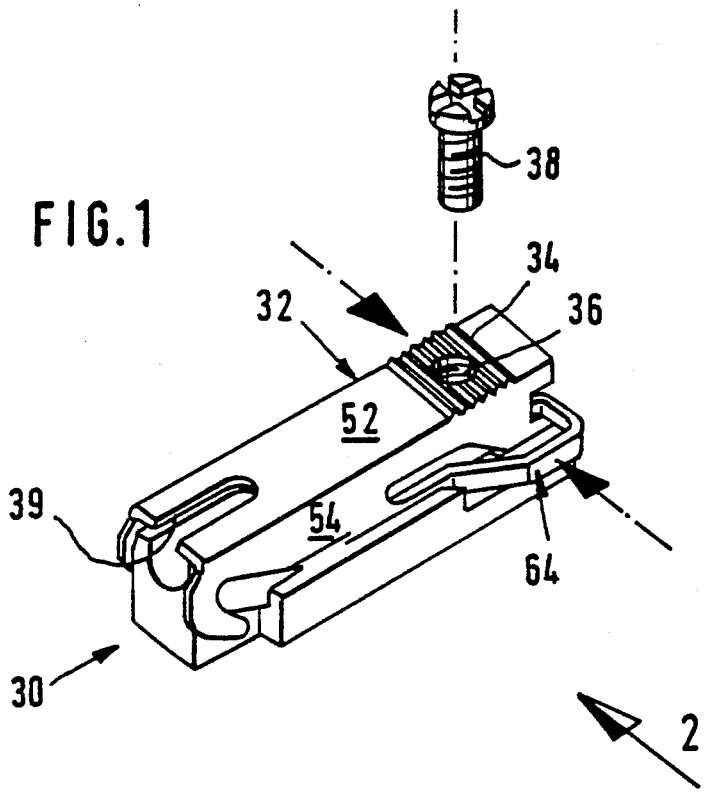
FIG. 1 is a perspective view of a first embodiment of the mounting plate improved in the manner of the invention.
Figure 2:
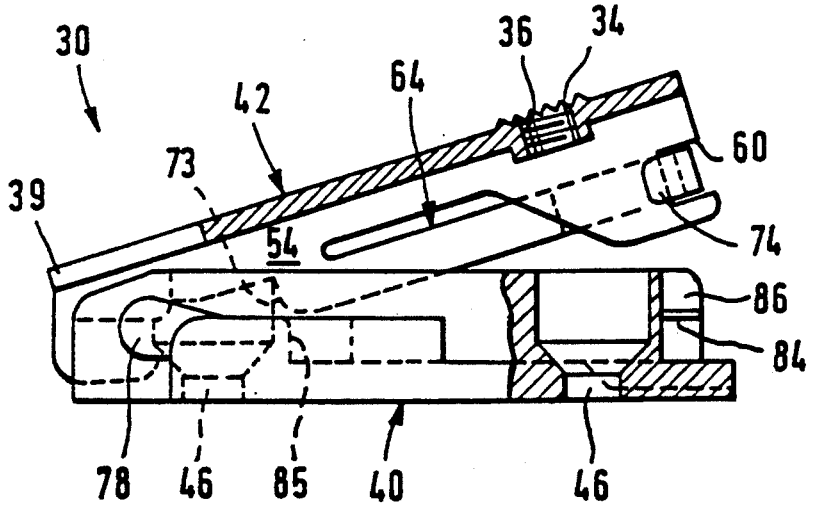
FIG. 2 is a side elevation of the mounting plate of FIG. 1, as seen in the direction of the arrow 2 in FIG. 1, the upper mounting plate member being represented in a longitudinal central section with its end portion raised up from the bottom mounting plate member and the carcase-interior end portion of the bottom mounting plate being cut away to show the catch mechanism.

In FIGS. 1 and 2 there is shown a first embodiment of a mounting plate configured in the manner of the invention and indicated as a whole by the number 30, on which the supporting wall-related part of a link hinge otherwise corresponding to the state of the art—and therefore not represented—is adjustably mounted. As regards the nature and manner of the configuration of the hinge supporting arm to be fastened on the mounting plate 30, suffice it to refer to the configuration of the hinge shown in FIGS. 1 and 2 of DE-OS 35 25 279 and described in the corresponding description.

The mounting plate 30 has an elongated, bar-shaped mounting section 32 in whose rear end area, i.e., the end pointing into the interior of the carcase, a tap 36 is provided within an area provided with transverse corrugations, and into this tap the shaft of a mounting screw 38 serving to fasten the hinge supporting arm can be threaded. In the front end area, i.e., the end pointing out of the carcase interior, the mounting section 30 has an opening 39 leading slot-wise on the top side into the front end of the mounting section 30 to accommodate the neck portion of a threaded pin (not shown) for the adjustment of the door-leaf overlap.

Figure 3:
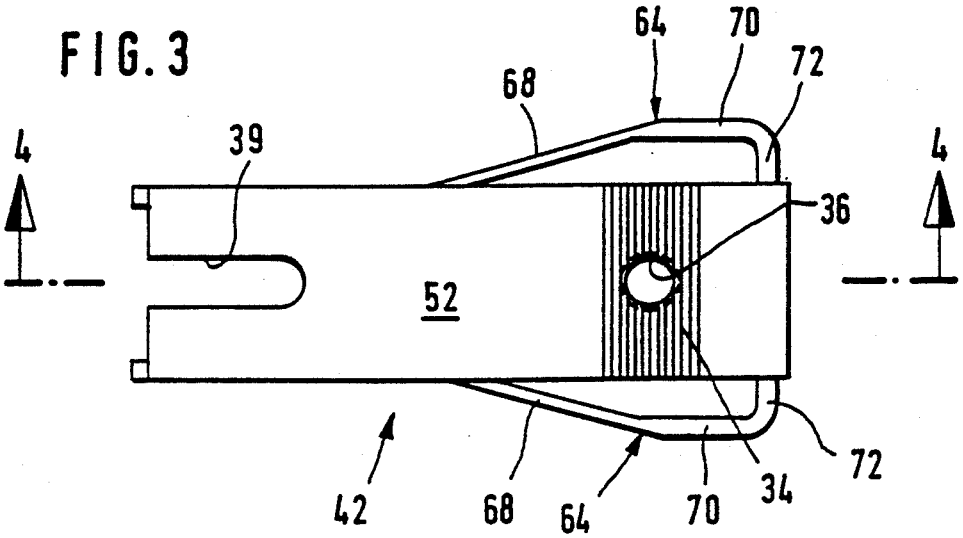
FIG. 3 is a top view of the upper mounting plate member of the mounting plate shown in FIGS. 1 and 2, as seen in the direction of arrow 3 in FIG. 4.
Figure 4:
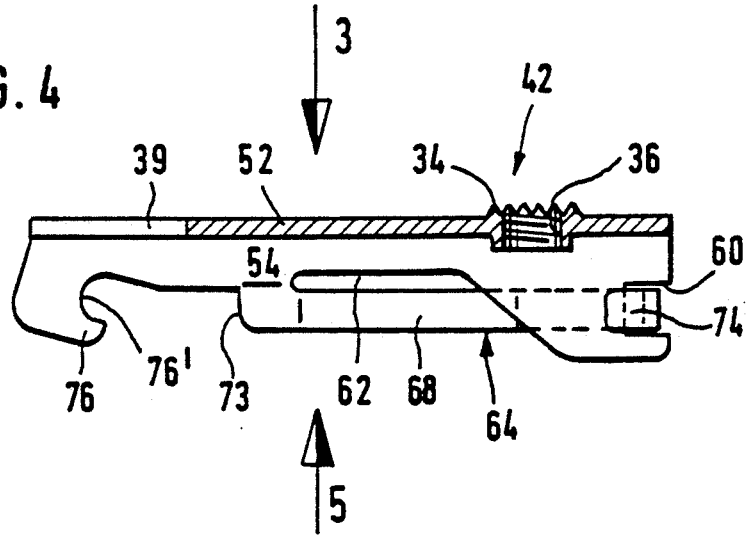
FIG. 4 is a section through the upper mounting plate member in the plane of section defined by the arrows 4—4 in FIG. 3.
Figure 5:
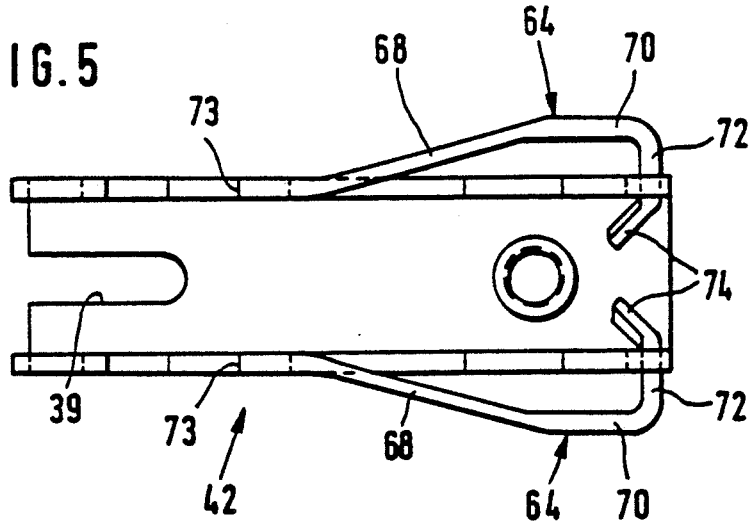
FIG. 5 is a bottom view of the upper mounting plate member, seen in the direction of the arrow 5 in FIG. 4.

The mounting plate 30 is bipartite and is composed of a bottom mounting plate member 40 to be fastened to the supporting wall of the carcase (FIGS. 2 and 7 to 9) and an upper mounting plate member 42 snap-fastened on the bottom mounting plate member 40 (FIGS. 3 to 5). The upper mounting plate member 42 substantially forming the mounting section 32 is placed upon the bottom mounting plate member 40 and locked thereon in the manner to be described below. The elongated, bar-shaped bottom mounting plate member 40, which in the illustrated case is a metal pressure casting, has two countersunk mounting bores 46 spaced apart from one another longitudinally, through which the threaded shafts of mounting screws (not shown) can be screwed into holes in the supporting wall of the carcase on which the mounting plate is to be fastened.

The upper mounting plate member 42 represented separately in FIGS. 3 to 5 is a metal stamping and has an inverted-U-shaped cross section, i.e., it is composed of an upper elongated web 52 and flanges 54 adjoining its opposite longitudinal margins and laterally overlapping the bottom mounting plate 40, the openended slot-like opening 39 being provided at the front or carcase-exterior end of the web 52. The carcase-interior or rearward end areas of the flanges have a greater width and are provided each with a notch 60 in the back edge of each flange.

By means of a cut or a slit 62 contained in the flange, elongated, strap-like sections have been cut free from the material and form the resilient tongues 64 to be further explained below, which in turn are part of a catch mechanism which permits the back end of the upper and bottom mounting plate members 42 and 40, respectively, to be releasably locked together.

The strap-like sections 64 cut free and forming the tongues are therefore integral at their forward end with the flanges 54, and in the tongue portion 68 directly adjoining the flanges and pointing outwardly and toward the carcase interior they have a reduced thickness. The flexural stiffness of the tongue is therefore reduced in this section 68, i.e., the tongues flex resiliently when pressure is applied laterally in this area. The resilient portions 68 are adjoined by tongue sections 70 bent back to a position parallel to the longitudinal central axis and forming a finger grip, from which another tongue section 72 is bent inwardly at right angles to the longitudinal central axis, from which finally a last tongue section forming the catch section 74 of the resilient tongues is bent, such that these catch sections include an angle of about 45° with the longitudinal central axis of the mounting plate, with their free end therefore pointing inward and forward at an angle in the manner seen in FIG. 5. The tongue sections 72 are each introduced through the notch 60 in the carcase-interior end of the associated flange 54. The height of the notches 60 corresponds substantially to the height of the tongue sections 72, so that these tongue sections 72 can be flexed resiliently in the notches 60 parallel to the carcase supporting wall, but they cannot be deformed at right angles to the supporting wall.

Between the hook 76 and the forward area of the transition of the tongues 64 into the flanges 54, the width of these flanges is reduced, so that in front of the tongues 64 a downwardly rounded vertical edge 73 is formed, which, together with associated vertical edges of the upper mounting plate member 40, which are rounded at the upper end and will be described below, assure that the two mounting plate members 42 and 40 will be locked together tightly in the longitudinal direction of the mounting plates.

At the forward end area, in each flange 54 of the upper mounting plate member 42, a hook 76 opening rearwardly at an angle is formed, which has a partially arcuate engaging surface 76'.

Figure 6:
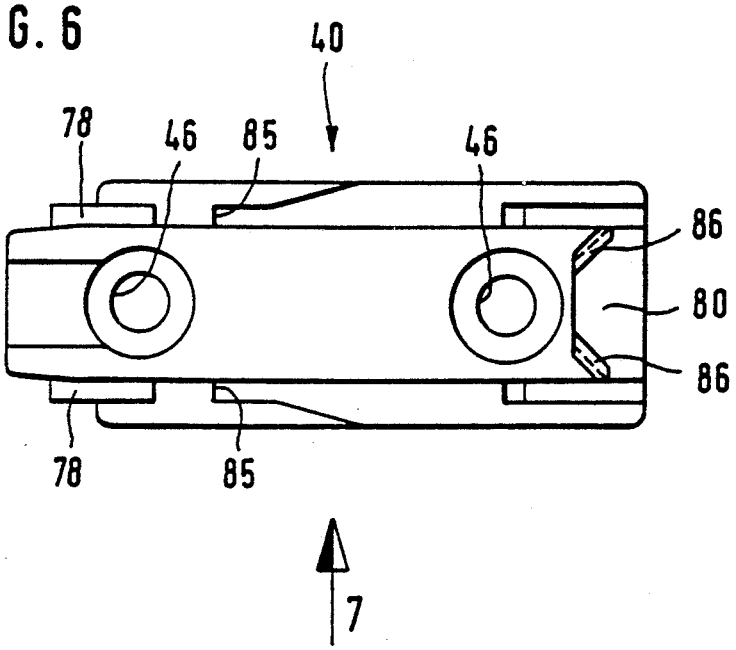
FIG. 6 is a top view of the bottom mounting plate member of the mounting plate shown in FIGS. 1 and 2, as seen in the direction of the arrow 6 in FIG. 7.
Figure 7:
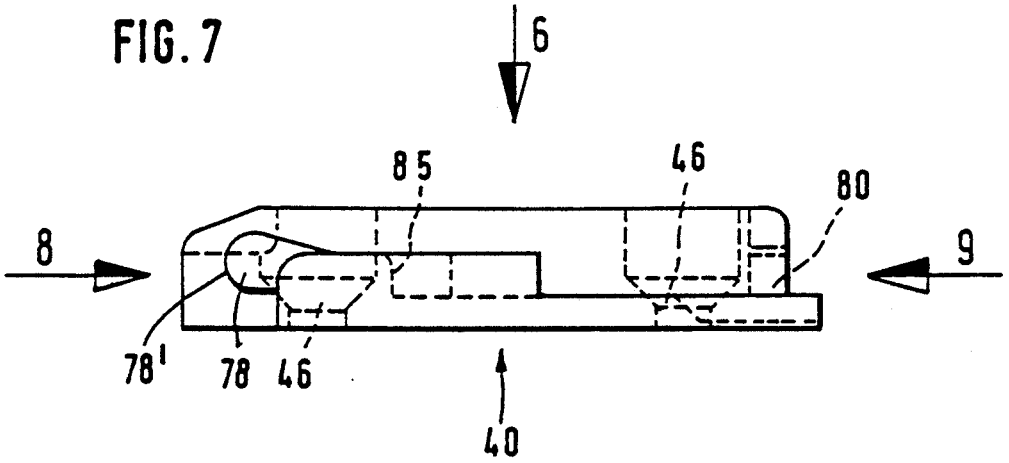
FIG. 7 is a side view of the bottom mounting plate member, as seen in the direction of arrow 7 in FIG. 6.
Figure 8:
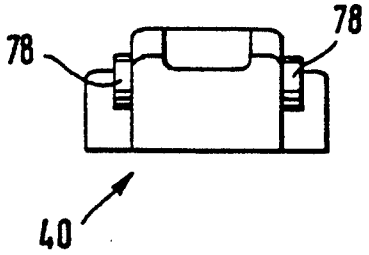
FIG. 8 is a front elevation of the bottom mounting plate member, seen in the direction of arrow 8 in FIG. 7.
Figure 9:
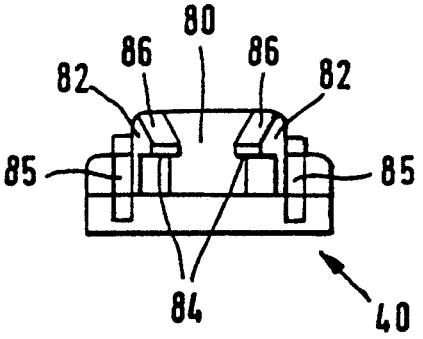
FIG. 9 is a rear view of the bottom mounting plate member, as seen in the direction of arrow 9 in FIG. 7.

With the hooks 76 there are associated hooking projections 78 projecting laterally on the bottom mounting plate member 40 (FIGS. 6 to 8), which have engaging surfaces 78' which are given at least section-wise a complementary arcuate shape, so that it is possible to guide the hook 76 of the upper mounting plate member 42, with the back end raised in the manner represented in FIG. 2, over the hooking projections 78 and then, after bringing the engaging surfaces 76' and 78' together, lowering the back end of the upper mounting plate onto the bottom mounting plate member 40. Then the catch sections of tongue 64, which are bent back within the mounting plate 42 from the tongue sections 74, enter into a recess 80 which is provided in the back end of the bottom mounting plate member and is open at the top and rearward end, and which is narrowed at the top by projections 82 which have a sloping shape matching the slope of the catch sections 74. On the bottom the bar-like projections 82 form undercut surfaces 84, while the upper surfaces opposite them are configured as ramp surfaces 86 tapering downward at an angle. When the rearward end of the mounting plate member 42 is swung downward onto mounting plate member 50, the inner ends of the catch sections 74 strike against the ramp surfaces 86 and then slide down on the ramp surfaces 86, with resilient deformation of the tongues 64, until their upper margins, upon reaching the intended catch position, pass over the narrow section formed between the projections 82 and snap beneath the undercut surfaces 84, and then the upper edge of the catch sections 74 locks against the associated undercut surface 84. Then it is no longer possible for the upper mounting plate member 42 to be raised back up again, unless first the catch sections are forced inwardly by applying a pressure to the tongue sections 70 forming the finger grips, to such an extent that they come free of the undercut surfaces 84. In practice, this unlocking pressure is best exercised by exerting a pressure between the thumb and index finger of the person performing the release on the outside of the tongue sections 70, in the direction indicated by the broken-line arrows in FIG. 1. As soon as the upper mounting plate member is unlocked from the bottom mounting plate member, i.e., as soon as the catch sections 74 come free of the undercut surfaces 84, the rearward end of the upper mounting plate member can be pulled upward with the fingers applying the pressure and thus the upper mounting plate member 42 can be raised. If in this case the supporting arm of a hinge is fastened on the upper mounting plate member 42, this arm will then be raised with it, which is possible, even if the door is held tight, since the supporting arm in turn is articulated by its joint mechanism to the door-related hinge part.

In order to lock the upper mounting plate member 42 on the bottom mounting plate 40 so as to have no free play longitudinally in the locked-on position, vertical edges 85 are formed in the bottom mounting plate 40 which are engaged by the vertical edges 73 provided in front of the tongue 64 in the lateral flanges 54 on the upper mounting plate member 42 when it is snapped in place.

No change takes place in the setting of the supporting arm on the upper mounting plate member, so that, when the upper mounting plate member is snapped back onto the bottom mounting plate member, the correct alignment of the supporting wall-related part of the hinge relative to the mounting plate 30, once found, will be regained.

Figure 10:
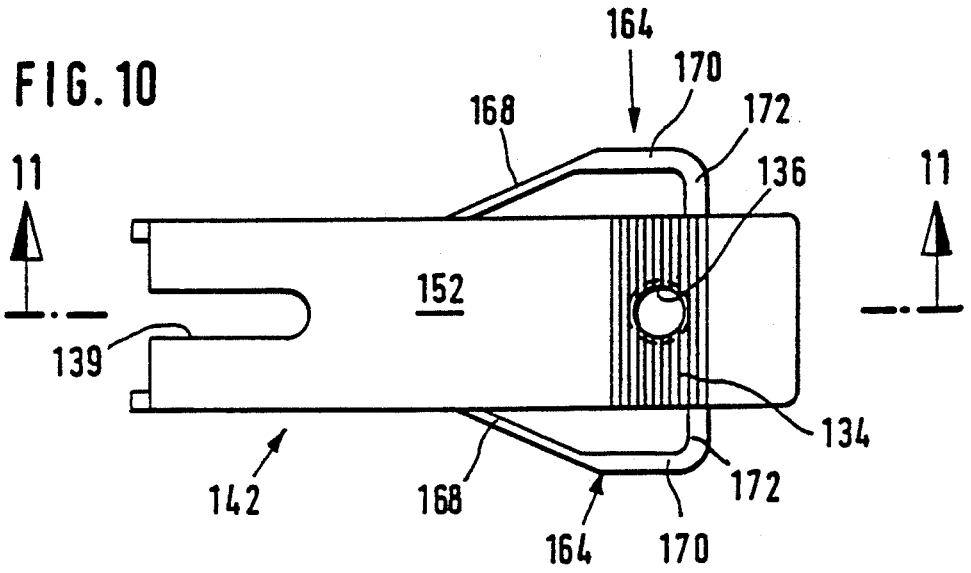
FIG. 10 is a top view of the upper mounting plate member of a second embodiment of the mounting plate according to the invention, as seen in the direction of the arrow 10 in FIG. 11.
Figure 11:
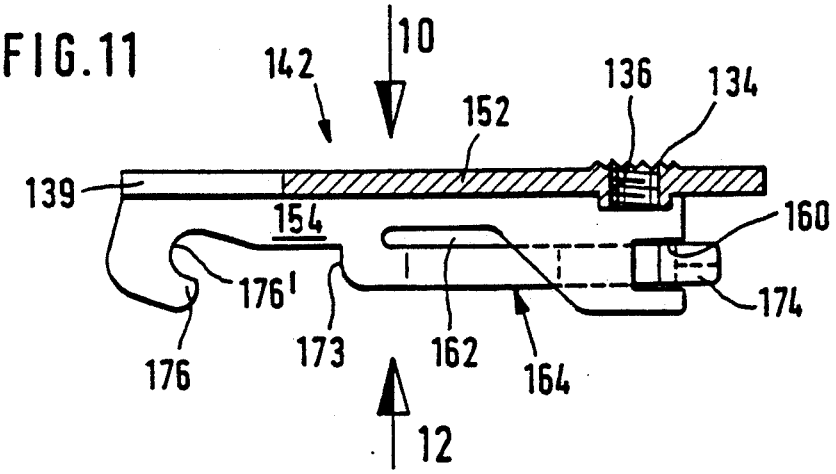
FIG. 11 is a section through the upper mounting plate member in the plane of section defined by the arrows 11—11 in FIG. 10.
Figure 12:
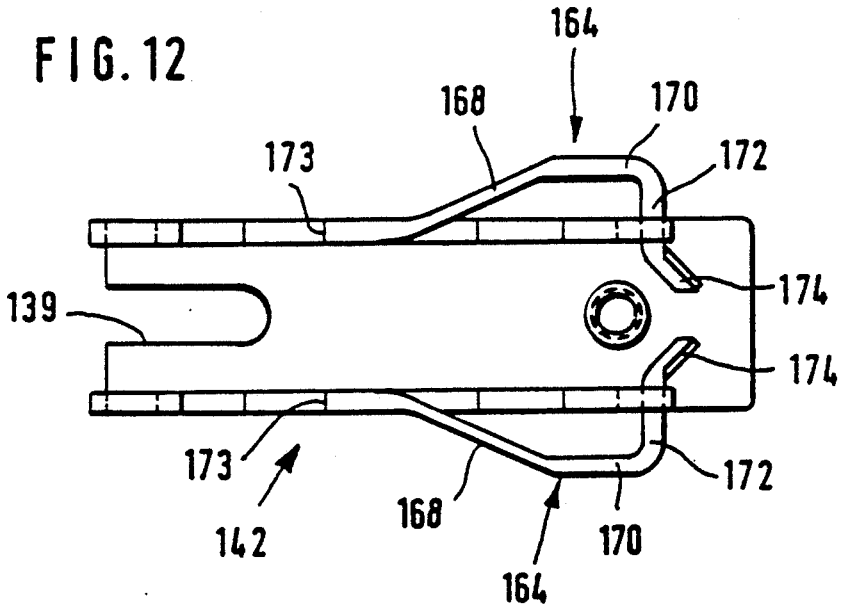
FIG. 12 is a bottom view of the upper mounting plate member, as seen in the direction of arrow 12 in FIG. 11.
Figure 13:
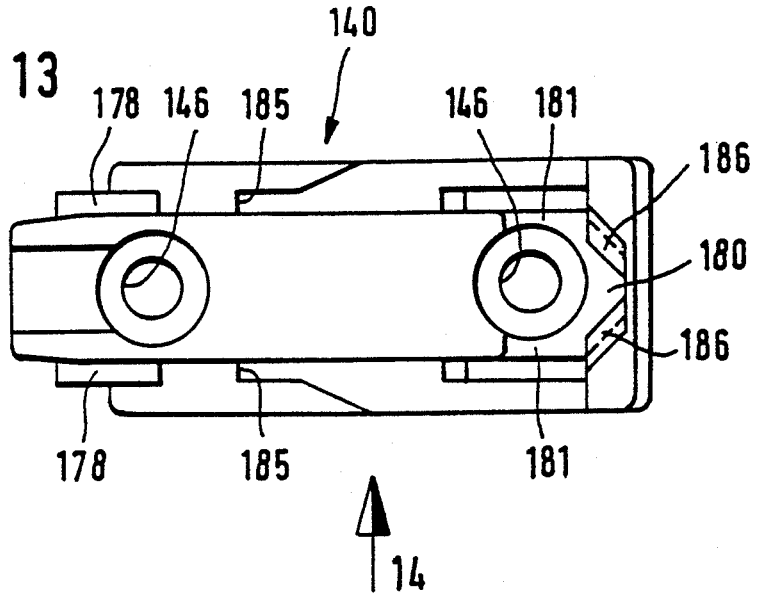
FIG. 13 is a top view of the bottom mounting plate member of the second embodiment of the mounting plate according to the invention, as seen in the direction of arrow 13 in FIG. 14.

In FIGS. 10 to 12 is shown the upper mounting plate member 142, and in FIGS. 13 to 16 the bottom mounting plate member 140, of a second embodiment of the mounting plate in accordance with the invention, which differs from the mounting plate 30 described above in conjunction with FIGS. 1 to 9 only in regard to the configuration of the catch mechanism. Consequently, only the changes made in the catch mechanism will be described below, while otherwise, to avoid repetitions, suffice it to refer to the foregoing description of mounting plate 30, inasmuch as functionally equal parts of the above mounting plate member 142 and of the bottom mounting plate 140, are identified in drawing FIGS. 10 to 12 and 13 to 16 by the same reference numbers, though preceded by a "1," as the corresponding parts of the upper mounting plate member 42 and bottom mounting plate member 40, respectively.

The essential difference in the catch mechanism of this embodiment is that the sections of the resilient tongues 164 forming the catch sections 174 are bent from the tongue sections 172 reaching inwardly from the tongue sections 170 that form the finger grips, not forwardly at an angle, but rearwardly at an angle of about 45°, i.e., with a component pointing into the interior of the cabinet carcase.

Accordingly, the catch sections 174 cannot be snapped into engagement from the carcase-interior end of the bottom mounting plate member 140 into the opening 180; instead, approximately in the area of the rear, countersunk fastening bore 146, this opening has notches 181 on the two opposite longitudinal sides of the bottom plate member 140, through which the tongue sections 172 can pass when the upper mounting plate member 142 is attached to the bottom mounting plate member, and then the catch sections 174 again cooperate with correspondingly angled projections 182 provided with undercut surfaces 184 on the bottom.

Figure 17:
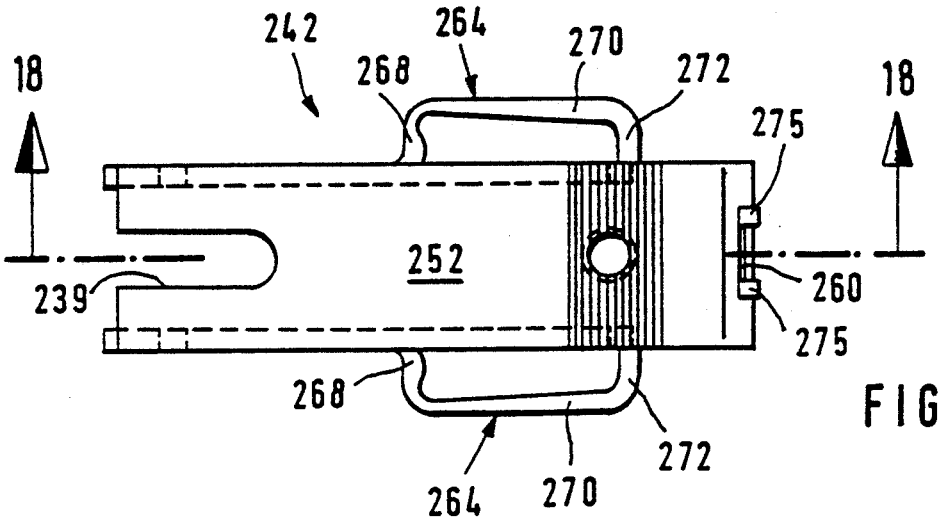
FIG. 17 is a top view of the upper mounting plate member of a third embodiment of the mounting plate according to the invention, as seen in the direction of arrow 17 in FIG. 18.
Figure 18:
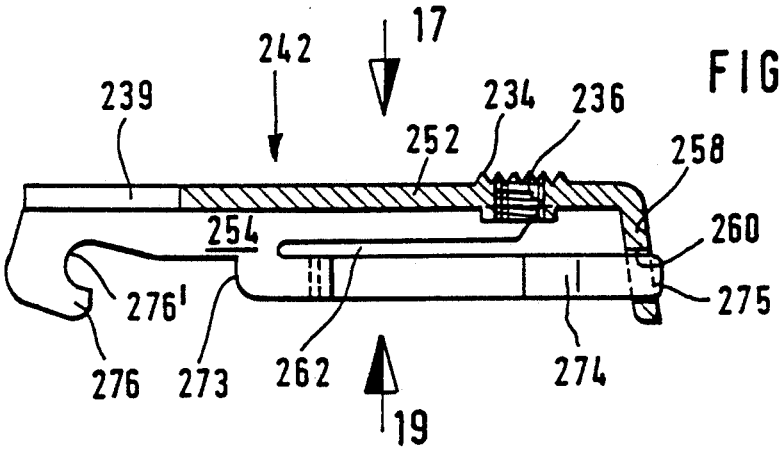
FIG. 18 is a section through the upper mounting plate member in the plane of section defined by the arrows 18—18 in FIG. 17.
Figure 19:
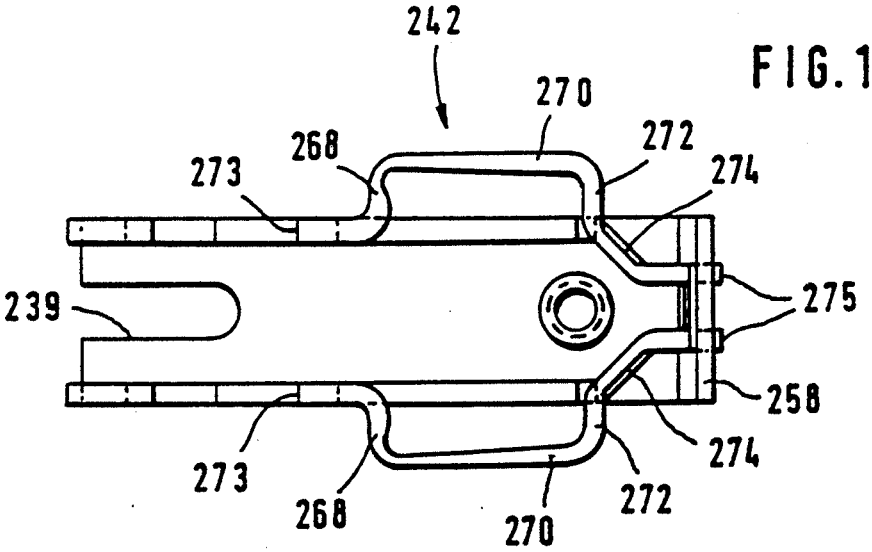
FIG. 19 is a bottom view of the upper mounting plate member, as seen in the direction of the arrow 19 in FIG. 18.
Figure 20:
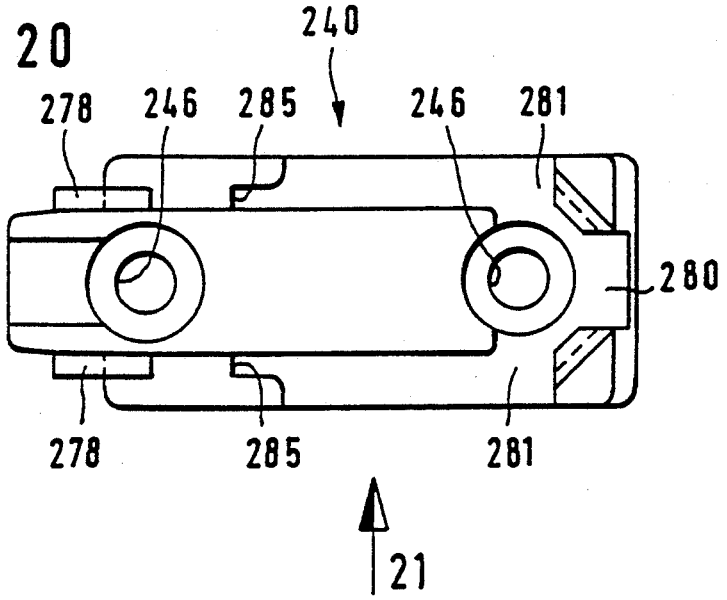
FIG. 20 is a top view of the bottom mounting plate member of the third embodiment of the mounting plate according to the invention, as seen in the direction of arrow 20 in FIG. 21.
Figure 21:
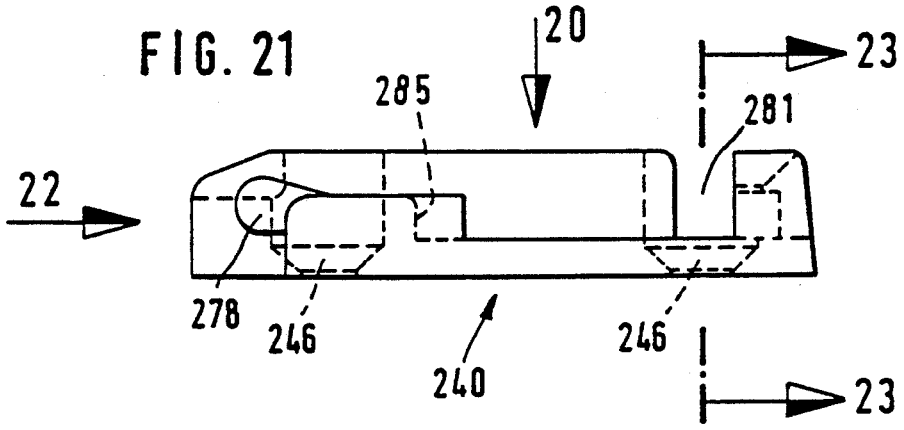
FIG. 21 is a side elevation of the bottom mounting plate member, as seen in the direction of arrow 21 in FIG. 20.
Figure 22:
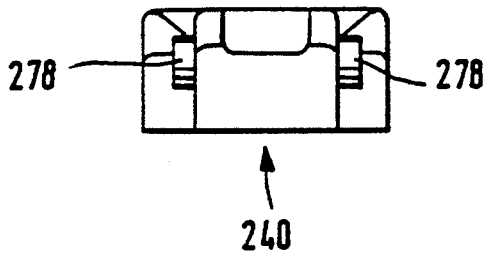
FIG. 22 is a front elevation of the bottom mounting plate member, as seen in the direction of arrow 22 in FIG. 21.
Figure 23:
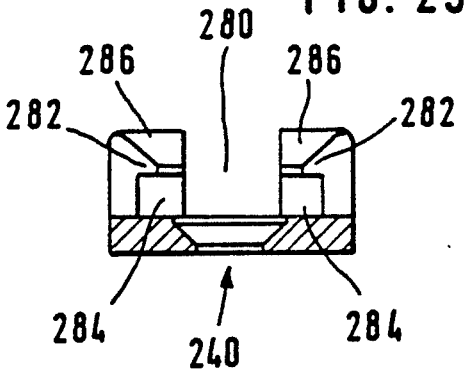
FIG. 23 is a section through the bottom mounting plate member as seen in the plane of section defined by the arrows 23—23.

In FIGS. 17 to 23 there is shown a third embodiment of the mounting plate in accordance with the invention; FIGS. 17 to 19 show the upper mounting plate member 242 and FIGS. 20 to 23 the bottom mounting plate member 240. Here, again, only the differences relating to the configuration of the catch mechanism will be discussed, while as for the configuration that remains the same it will suffice to refer to the preceding description. Functionally identical parts are again given identical reference numbers, but in the case of the third embodiment the numbers are prefixed with a "2."

Figure 14:
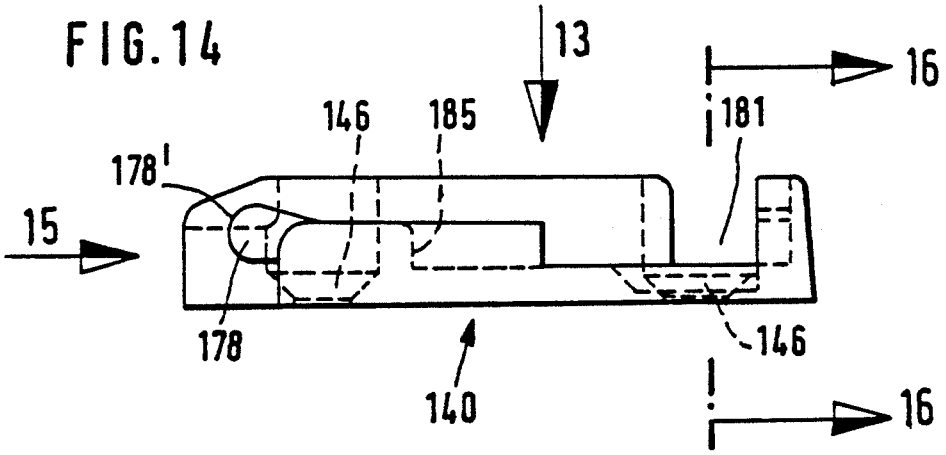
FIG. 14 is a side elevation of the bottom mounting plate member, as seen in the direction of arrow 14 in FIG. 13.
Figure 15:
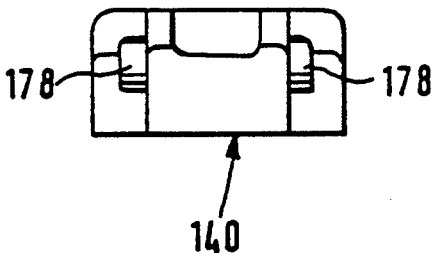
FIG. 15 is a front elevation of the bottom mounting plate member, seen in the direction of arrow 15 in FIG. 14.
Figure 16:
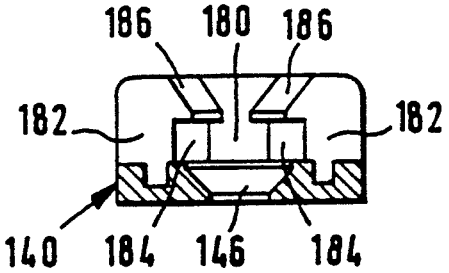
FIG. 16 is a sectional view of the bottom mounting plate member, as seen in the direction of arrows 16—16 in FIG. 14.

The differences in the catch mechanism are limited essentially to the upper mounting plate member 242, while the bottom mounting plate member 240 corresponds essentially to the bottom mounting plate member 140 in FIGS. 14 to 16.

One difference that is striking when one considers FIGS. 17 and 19 in comparison with the upper mounting plate members 42 and 142 in the embodiments described above, is a slightly modified configuration of the resilient tongues 264, insofar as the tongue sections 268 corresponding to tongue sections 68 and 168 do not run backwards at an angle into the carcase interior but are bent outwardly at right angles in opposite directions from the lateral flanges 254, and then the adjoining tongue sections 270 forming the finger grips are again bent from tongue sections 268 at right angles toward the carcase interior to a position parallel to the flanges 254. The reduction of the thickness of the tongue material permitting the resilient flexure of the tongues 264 is provided in the area of transition between the tongue sections 268 and 270.

Another difference from the configuration of the two embodiments previously described is that the flanges 254 of the upper mounting plate member 242 are not only not made wider at the rearward end but are cut back to the web 252, eliminating the possibility of guiding the carcase-interior end of the tongues vertically in notches in the lateral flanges.

Instead, at the rearward end of the web 252 a downwardly bent end 258 is provided, in which a window-like slot 260 runs transversely at the level of the tongues 264, and through it pass elongated tongue-end sections 275 adjoining the actual catch sections 274 running at an angle. Since the height of the window-like slot 260 and the height of these tongue-end sections 275 are again approximately equal, the window-like slot 260 thus serves the same guiding function as the notches 60 and 160 in the lateral flanges 54 and 154, respectively, of the examples described previously.

The bottom mounting plate member 240 shown in FIGS. 20 to 23 is virtually the same, as previously mentioned, as the bottom mounting plate member 142, so that another description of this bottom mounting plate member 242 is not necessary.

I claim:

1. Mounting plate for the adjustable mounting of the supporting wall-related part of a cabinet hinge, which is composed of two separable mounting plate members, of which the bottom mounting plate member nearer the supporting wall can be fastened fixedly to the supporting wall and the upper mounting plate member, which is farther from the supporting wall and adjustably holds the carcase-related member of the cabinet hinge, can be fastened by a resilient catch mechanism to the bottom mounting plate member, the bottom mounting plate member having in its front end portion adjacent the door leaf at least one hook projection with which a hook on the bottom of the upper mounting plate member is associated, and the associated engagement surfaces of the hook projection and hook being configured in a complementary manner and being approximately arcuate at least in sections, and the upper mounting plate member partially overlapping the bottom mounting plate member at least in its end portion pointing into the carcase interior and being provided in the overlapping portion with two tongues which are resiliently flexible parallel to the supporting wall surface and have each a catch section, which catch sections are interlocked each with an associated catch receiver, and the catch sections and the catch receivers being able nevertheless to be brought out of engagement by flexing the tongues against one another parallel to the supporting wall surface, and each tongue having a finger grip that is accessible when the two mounting plate members are in the coupled state for the exertion of a pressure directed against one another parallel to the supporting wall surface, characterized in that the catch sections (74, 174, 274) provided on the resiliently flexible tongues (64, 164, 264) and the associated catch receivers run at an angle between 30° to 60° with respect to the longitudinal central axis of the mounting plate (30).

2. Mounting plate of claim 1, characterized in that the upper mounting plate member (42, 142, 242) has an inverted U-shaped cross section with an upper elongated web surface (52, 152, 252) and flanges (54, 154, 254) adjoining its longitudinal edges and at least partially overlapping the bottom mounting plate member (40, 140, 240) laterally, that the two resilient tongues (64, 164, 264) are fastened at their front end pointing out of the carcase interior to the upper mounting plate member (42, 142, 242) and are shaped in their resilient area offset in the direction of the carcase interior such that they project laterally beyond the limits of the upper mounting plate member (42, 142, 242) at least sectionwise, and that between the confronting inside surfaces of the resilient tongues (64, 164, 264) a clear space exists which permits the horizontal deformation of the tongues (64, 164, 264) against one another by the amount necessary for release.

3. Mounting plate of claim 2, characterized in that the resilient tongues (64, 164, 264) are integral strip-like sections cut free from the material of the upper mounting plate member (42, 142, 242).

4. Mounting plate of claim 2 or 3, characterized in that the catch receivers provided in the bottom mounting plate member (40, 140, 240) have on the upper side facing the upper mounting plate member (42, 142, 242) an open-ended opening (80, 180, 280) for the introduction of the catch sections provided on the resilient tongues (64, 164, 264), that the introduction opening and/or the catch sections are provided each with at least one ramp surface (86, 186, 286) forcing the associated catch section resiliently, upon introduction, in the release direction and then in the direction of introduction, with an undercut surface (84, 184, 284) behind which the catch sections snap back together upon reaching the intended locking position of the two mounting plate members (40, 42; 140, 142; 240, 242).

5. Mounting plate of any one of claims 2 to 3, characterized in that the resilient tongues (64, 164, 264) are divided adjacent to their fastening area on the upper mounting plate member (42, 142, 242) or at the areas of their transition into the associated lateral flange 54, 154, 254) of the upper mounting plate member, into a plurality of tongue sections running at an angle to one another, the first of which (68, 168, 264) is bent outwardly, the adjoining tongue section (70, 170, 270) is bent back to a position disposed approximately parallel to the mounting plate's longitudinal central axis, and the next adjoining tongue section (72, 172, 272) is bent approximately at right angles to the longitudinal central axis, while the terminal sections adjoining the tongue sections bent at right angles to the longitudinal central axis and forming the actual catch sections (74, 174, 274), are bent to a position at an angle to the longitudinal central axis.

6. Mounting plate of claim 5, characterized in that the tongue sections (72, 172) bent at approximate right angles to the longitudinal central axis are guided by a notch (60, 160) in the carcase-interior end portion of the associated lateral flange (54, 154) of the upper mounting plate member (42, 142), and the inside height of the notches measured at right angles to the supporting wall surface is approximately equal to or only slightly larger than the height of the tongue (64, 164) in the area running through the notch (60, 160).

7. Mounting plate of claim 6, characterized in that the tongue sections forming the catch section (74) can be bent from the associated tongue sections bent at right angles to the longitudinal central axis to a slanting position having a component pointing out of the carcase.

8. Mounting plate of claim 6, characterized in that the tongue sections (172, 272) forming the catch section (174, 274) are bent from the associated tongue sections bent approximately at right angles to the longitudinal central axis to a slanting position having a component pointing into the carcase interior.

9. Mounting plate of claim 8, characterized in that a tongue section (275) running substantially parallel to the longitudinal central axis of the mounting plate is added to the tongue sections forming the catch section (274) and can be brought through a window-like slot (260) in a wall (258) bent from the carcase-interior end of the web (252) of the upper mounting plate member (242) in the direction of its lateral flanges, in which case the clear height of this window-like slot (260), measured at right angles to the supporting wall surface, is approximately equal to or only slightly greater than the height of the tongue sections (275) passing through it, while the clear length of the slot (260) measured in the direction of actuation of the tongue when releasing is sized in accordance with the distance the tongue has to be flexed for release.

10. Mounting plate of claim 1 wherein said associated catch receivers run at an angle of approximately 45° with respect to the longitudinal central axis of the mounting plate (30).

11. Mounting plate of claim 10, characterized in that the upper mounting plate member (42, 142, 242) has an inverted U-shaped cross section with an upper elongated web surface (52, 152, 252) and flanges (54, 154, 254) adjoining its longitudinal edges and at least partially overlapping the bottom mounting plate member (40, 140, 240) laterally, that the two resilient tongues (64, 164, 264) are fastened at their front end pointing out of the carcase interior to the upper mounting plate member (42, 142, 242) and are shaped in their resilient area offset in the direction of the carcase interior such that they project laterally beyond the limits of the upper mounting plate member (42, 142, 242) at least sectionwise, and that between the confronting inside surfaces of the resilient tongues (64, 164, 264) a clear space exists which permits the horizontal deformation of the tongues (64, 164, 264) against one another by the amount necessary for release.

12. Mounting plate of claim 11, characterized in that the resilient tongues (64, 164, 264) are integral strip-like sections cut free from the material of the upper mounting plate member (42, 142, 242).

13. Mounting plate of claim 11 or 12, characterized in that the catch receivers provided in the bottom mounting plate member (40, 140, 240) have on the upper side facing the upper mounting plate member (42, 142, 242) an open-ended opening (80, 180, 280) for the introduction of the catch sections provided on the resilient tongues (64, 164, 264), that the introduction opening and/or the catch sections are provided each with at least one ramp (86, 186, 286) forcing the associated catch section resiliently, upon introduction, in the release direction and then in the direction of introduction, with an undercut (84, 184, 284) behind which the catch sections snap back together upon reaching the intended locking position of the two mounting plate members (40, 42; 140, 142; 240, 242).

14. Mounting plate of any one of claims 11 or 12, characterized in that the resilient tongues (64, 164, 264) are divided adjacent to their fastening area on the upper mounting plate member (42, 142, 242) or at the areas of their transition into the associated lateral flange (54, 154, 254) of the upper mounting plate member, into a plurality of tongue sections running at an angle to one another, the first of which (68, 168, 264) is bent outwardly, the adjoining tongue section (70, 170, 270) is bent back to a position disposed approximately parallel to the mounting plate's longitudinal central axis, and the next adjoining tongue section (72, 172, 272) is bent approximately at right angles to the longitudinal central axis, while the terminal sections adjoining the tongue sections bent ar right angles to the longitudinal central axis and forming the actual catch sections (74, 174, 274), are bent to a position at an angle to the longitudinal central axis.

15. Mounting plate of claim 14, characterized in that the tongue sections (72, 172) bent at approximately right angles to the longitudinal central axis are guided by a notch (60, 160) in the carcase-interior end portion of the associated lateral flange (54, 154) of the upper mounting plate member (42, 142), and the inside height of the notches measured at right angles to the supporting wall surface is approximately equal to or only slightly larger than the height of the tongue (64, 164) in the area running through the notch (60, 160).

16. Mounting plate of claim 15, characterized in that the tongue sections forming the catch section (74) can be bent from the associated tongue sections bent at right angles to the longitudinal central axis to a slanting position having a component pointing out of the carcase.

17. Mounting plate of claim 15, characterized in that the tongue sections (172, 272) forming the catch section (174, 274) are bent from the associated tongue sections bent approximately at right angles to the longitudinal central axis to a slanting position having a component pointing into the carcase interior.

18. Mounting plate of claim 17, characterized in that a tongue section (275) running substantially parallel to the longitudinal central axis of the mounting plate is added to the tongue sections forming the catch section (274) and can be brought through a window-like slot (260) in a wall (258) bent from the carcase-interior end of the web (252) of the upper mounting plate member (242) in the direction of its lateral flanges, in which case the clear height of this window-like slot (260), measured at right angles to the supporting wall surface, is approximately equal to or only slightly greater than the height of the tongue sections (275) passing through it, while the clear length of the slot (260) measured in the direction of actuation of the tongue when releasing is sized in accordance with the distance the tongue has to be flexed for release.

* * * * *